United States Patent [19]

Smith

[11] Patent Number: 5,065,732

[45] Date of Patent: Nov. 19, 1991

[54] BOW SLING

[76] Inventor: Scott D. Smith, 2400 E. Chicago Rd., Jonesville, Mich. 49250

[21] Appl. No.: 545,543

[22] Filed: Jun. 29, 1990

[51] Int. Cl.[5] ..... F41B 5/00

[52] U.S. Cl. ..... 124/88; 124/23.1; 224/916; 224/258

[58] Field of Search ..... 124/88, 86, 89, 23.1; 224/916, 150, 257, 258

[56] References Cited

U.S. PATENT DOCUMENTS

| | | | |
|---|---|---|---|
| 3,055,354 | 9/1962 | Gates | 124/23.1 |
| 3,204,626 | 9/1965 | Morneau | 124/88 X |
| 3,207,145 | 9/1965 | Browning et al. | 124/88 X |
| 3,998,367 | 12/1976 | Harding . | |
| 4,249,686 | 2/1981 | Morwood | 224/150 |
| 4,714,071 | 12/1987 | Saunders | 124/88 |
| 4,754,904 | 7/1988 | Fischer et al. | 224/916 X |
| 4,760,944 | 8/1988 | Hughes | 124/23.1 X |
| 4,768,689 | 9/1988 | Davis | 224/150 X |

*Primary Examiner*—Peter M. Cuomo
*Attorney, Agent, or Firm*—Beaman & Beaman

[57] ABSTRACT

A bow sling for attachment to an archery bow for assisting the archer in carrying and steadying the bow during aiming and firing of an arrow. The bow sling comprises an elongated strap formed of elastomeric material having a pair of legs extending from one end adapted to be attached to the bow's limbs. An adjustable loop is formed adjacent the opposite end of the strap adapted to be received around the archer's bow string pulling shoulder such that the strap extends behind the archer's neck and over the shoulder of the bow holding arm to support the bow in front of the archer in a steadying or carrying position, and the bow sling permits the bow to be conveniently and quickly grasped and raised to a firing position whereby the elasticity of the sling supports the bow against the archer's palm permitting the bow hand to relax during aiming and firing.

10 Claims, 1 Drawing Sheet

BOW SLING

BACKGROUND OF THE INVENTION

One of the difficulties encountered in the sport of archery, even by experienced archers, is maintaining the bow in a steady state condition while aiming and firing an arrow. As the archer must grasp the bow with one hand while utilizing the other hand to pull back on the bow string, the tension forces exerted on the bow require a firm grip on the handle during string pull-back and to prevent the bow from springing out of the archer's hand upon release of the bow string. Muscle fatigue and cramping in the bow hand and arm are often experienced which leads to inaccuracy.

In an attempt to overcome these difficulties, a variety of bow slings have been proposed to assist the archer during aiming and firing of an arrow, and such bow slings may also be utilized to assist the archer in carrying the bow. A typical bow sling consists of a strap or glove like member which is attachable to the bow adjacent the handle and has a loop or glove like portion adapted to receive the archer's wrist or bow hand to support the bow against the archer's palm as shown in U.S. Pat. Nos. 3,055,354 and 4,714,071. The bow slings are securely tightened to the archer's hand, or wrist, and the bow by adjustable portions. This permits the archer to relax the hand during aiming and firing of an arrow for improved accuracy, and permits the archer to carry or hold the bow without having to grip it with the hand.

Although such bow slings have experienced some degree of success, the bow slings themselves are not quickly applied to the wrist or hand and require tightening which is an inconvenience for the archer. Thus, it is not possible for the archer to conveniently or quickly fire a shot with the bow while utilizing the bow sling unless the bow sling has been previously applied. However, as such bow slings restrict the archer's hand to the bow, freedom of movement of the archer's hand and arm are lost once the sling is applied. While harness type slings are available which facilitate carrying of an archery bow in a hands free condition such as shown in U.S. Pat. No. 3,998,367 such harness type slings are not adapted to assist the archer in steadying the bow during aiming and firing of an arrow.

It is an object of the invention to provide a bow sling which is adapted to assist the archer in steadying the bow during aiming and firing of an arrow for improved accuracy wherein the bow sling is not applied to the archer's wrist or hand.

Another object of the invention is to provide a bow sling which is adapted to assist the archer in maintaining the bow in a steady state condition during aiming and firing of an arrow and also permits the bow to be carried in a hands free condition.

A further object of the invention is to provide a bow sling which permits the archer to conveniently and quickly reposition the bow between carrying and firing positions.

Yet a further object of the invention is to provide a bow sling comprising a strap primarily formed of elastomeric material wherein one end of the strap is adapted to be attached to the bow and the other end around a portion of the archer's body, and upon raising the bow to a firing position, the elasticity of the bow sling tends to bias the bow against the archer's palm permitting the archer's hand to relax.

Another object of the invention is to provide a bow sling which is adapted to be utilized with a variety of bows and is readily adjustable to meet the needs of a particular archer.

Still a further object of the invention is to provide a bow sling which is durable, simple to use, and economical to manufacture.

In the practice of the invention the bow sling is adapted to be utilized in conjunction with an archery bow having a pair of limbs extending in opposite directions from a handle and having a bow string extending between the outer ends of the limbs. The bow sling comprises an elongated strap formed of an elastomeric material, such as rubber, having a pair of legs extending from one end. Each leg is provided with a pair of complementary fastener portions for snapping the end of the legs shut in a loop upon doubling the legs back over upon themselves, and a plurality of spaced snap fasteners are affixed to the elongated strap along the length thereof.

The bow sling also includes a loop forming non-elastic strap having a pair of ends and a fastener affixed thereto adjacent each end adapted to releasably snap with any one of the spaced snap fasteners on the elongated strap to form an adjustable size loop adjacent the end of the elongated strap opposite the legs. The bow sling is applied to the bow simply by snapping the legs' loops to the bow limbs such that one leg is attached to each side of the bow's handle.

In use, the adjustable loop is received around the archer's bow string pulling shoulder such that the elongated strap extends behind the archer's neck and back over the shoulder of the bow holding arm to support the bow in front of the archer in a carrying position. In the carrying position, the bow sling permits the bow to be conveniently and quickly grasped and raised to a firing, position, in which case the archer's arm is fully extended and the elasticity of the bow sling draws and supports the bow against the archer's palm permitting the archer's hand to relax during aiming and firing of an arrow to assist the archer in steadying the bow for improved firing accuracy.

The adjustable loop permits the overall length of the bow sling to be readily adjusted to meet the needs of a particular archer while the legs' loops are readily adapted to be attached to a variety of bows. If desired, the bow sling may be utilized to transport the bow in a hands free condition against the archer's back. This is accomplished simply by attaching one of the legs to the same bow limb as the other leg and then snapping the adjustable loop portion about the opposite limb as to that of which the legs are fastened to form a harness adapted to extend across the archer's chest.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
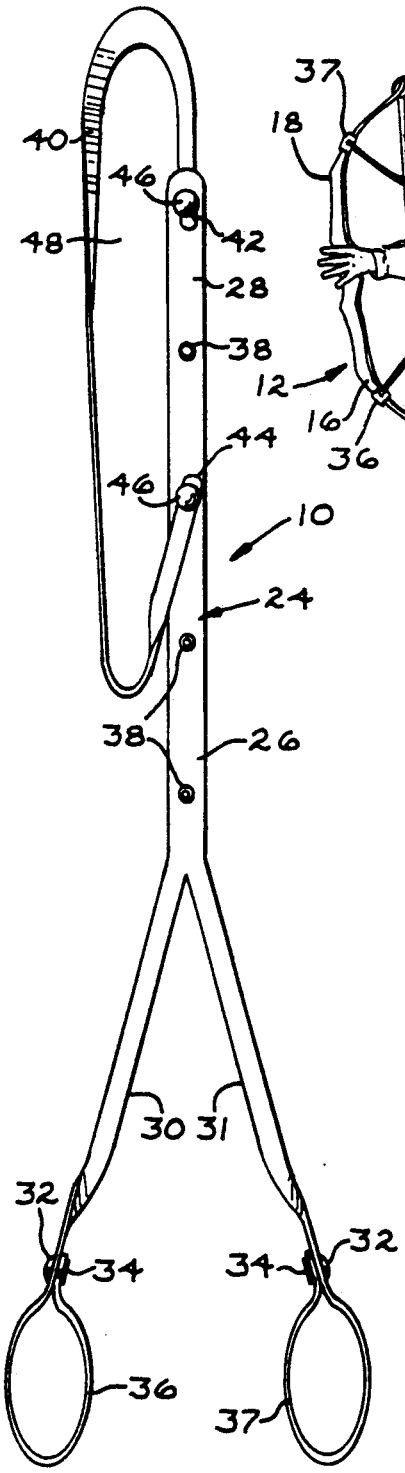
FIG. 1 is an elevational view of the bow sling of the invention.

In FIG. 1 a bow sling incorporating the inventive concepts is generally indicated at 10. The bow sling 10 is adapted to be attached to an archery bow for both aiding an archer in carrying the bow and for steadying the bow during aiming and firing of an arrow. In FIGS. 2–6 a typical compound archery bow with which the bow sling of the invention is adapted to be employed is generally indicated at 12 and includes a hand grip 14 and a pair of limbs 16 and 18 extending in opposite directions from the hand grip 14. A cable 20 is attached to the extreme outer ends of the limbs passing over the bow pulleys and defines the bow string 22.

Referring to FIG. 1, the bow sling 10 includes a thin elongated strap 24, preferably formed of an elastomeric material, such as rubber, having end regions 26 and 28. A pair of substantially identical legs 30 and 31 homogeneously extend from the end region 26. Each leg 30 and 31 is provided with a pair of complementary snap fasteners 32 and 34 adapted to be releasably snapped together to secure the end of the legs upon themselves upon doubling the legs back over to form loops 36 and 37, respectively. The loops 36 and 37 are of sufficient dimension to receive one of the bow's limbs. A plurality of snap fasteners 38 are affixed to the strap 24 along the length thereof at predetermined spaced locations.

The bow sling 10 also includes a loop forming flexible nonelastic web strap 40 having a pair of ends 42 and 44. Snap fasteners 46 are affixed to the strap 40 adjacent each end thereof. The fasteners 46 are complementary to the snap fasteners 38 and may be selectively snapped to any one of the fasteners 38 whereby the strap 40 forms a loop having an opening 48 adjacent the end region 28. The overall length of the bow sling 10 is defined by the distance between the loops 36 and 37 and the strap loop 40, and the length of the bow sling may be readily adjusted to meet the needs of a particular archer simply by snapping the fasteners 46 of the strap 40 to the desired fasteners 38. The bow sling 10 is secured to the bow 12 by snapping the loops 36 and 37 around the limbs 16 and 18, respectively.

Figure 2:
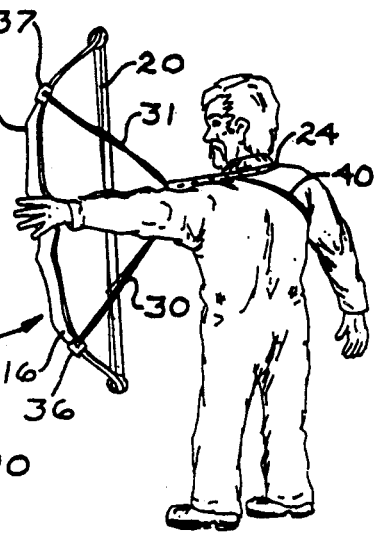
FIG. 2 is a view illustrating the back of an archer utilizing the bow sling for steadying the bow in a firing position prior to loading an arrow for firing.
Figure 3:
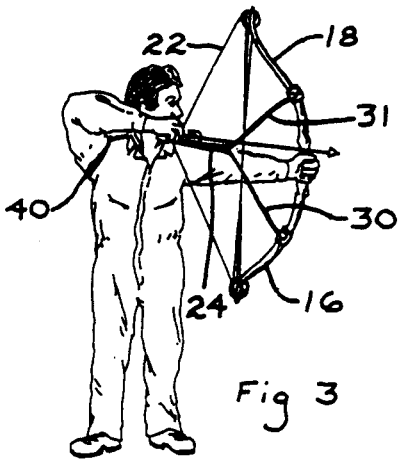
FIG. 3 is a view illustrating the front of an archer utilizing the bow sling for steadying the bow in a firing position during aiming and firing of an arrow.
Figure 4:
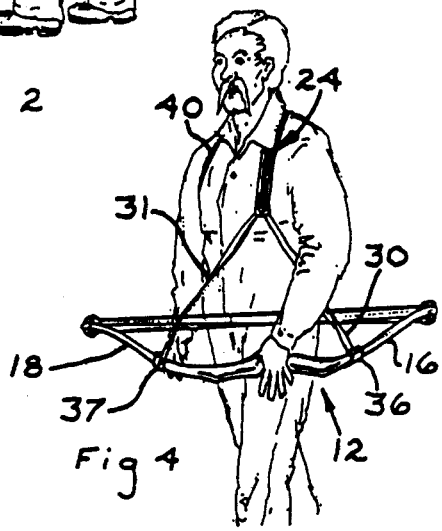
FIG. 4 is a view of the archer utilizing the bow sling to support the bow in a carrying position.

In use, the strap loop 40 is received over the archer's bow string pulling arm such that the strap 24 extends around the shoulder and behind the archer's neck, as will be best appreciated in FIG. 2, and back over the shoulder of the bow holding arm whereby the legs 30 and 31 support the bow 12 horizontally in front of the archer in a carrying position, FIG. 4. In this carrying position, the bow sling 10 permits the archer to conveniently and quickly grasp and raise the bow 12 to a firing position such as illustrated in FIGS. 2 and 3 wherein the archer's bow holding arm is fully extended.

Upon the archer raising the bow 12 to the firing position, the elasticity of the bow sling 10 draws the bow toward the archer supporting the bow grip 14 against the archer's palm which permits the archer to relax the hand during aiming and firing of an arrow. This aids the archer in maintaining the bow in a steady state condition, thereby, improving firing accuracy. Because the bow sling eliminates the necessity of the archer having to tightly grip the bow, muscle fatigue and cramping in the archer's hand and arm is eliminated or significantly reduced which leads to greater accuracy.

Figure 6:
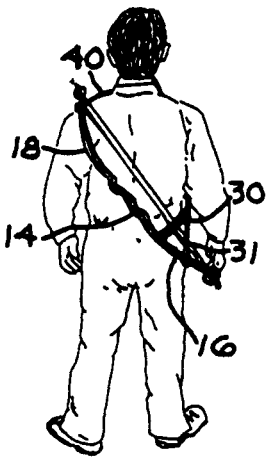
FIG. 6 shows the bow transporting position as taken from behind the archer.
Figure 5:
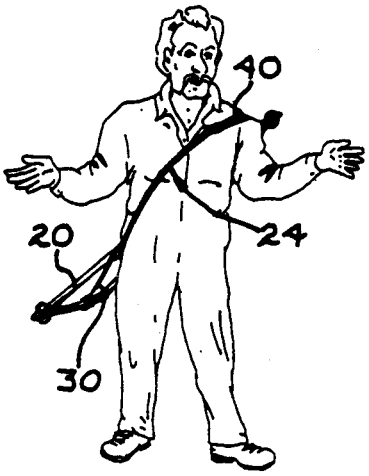
FIG. 5 is a front view of the archer utilizing the bow sling as a harness for transporting the bow against the archer's back in a hands free condition.

If desired, the bow sling 10 may be utilized as a harness to carry the bow against the archer's back in a hands free condition as illustrated in FIGS. 5 and 6. For this type of application, either one of the legs 30 or 31 is simply fastened to the same bow limb as the other leg while the strap loop 40 is wrapped around the other bow limb and snapped shut. In this manner, the bow sling 10 is adapted to extend across the archer's chest and support the bow against the archer's back.

As the bow sling 10 is neither applied to the archer's hand nor wrist, freedom of movement of the archer's hand and arm is maintained. The construction of the bow sling permits the bow sling to be readily employed with a variety of bows while the adjustable loop 40 permits the overall dimension of the opening 48 and the length of the bow sling to be readily adjusted to meet the needs of various archers. Also, the bow sling incorporates a simple construction which is of economical manufacture yet, durable over extended periods of usage.

It is to be understood that various modifications to the bow sling of the invention may be made without departing from the scope of the inventive concepts. For instance, the strap 40 may homogeneously extend from the strap 24, or either of the legs 30 and 31 may be separate from the strap 24 and affixed thereto by fasteners in a manner similar to the strap 40.

It is appreciated that various other modifications to the inventive concepts may be apparent to those skilled in the art without departing from the spirit and scope of the invention.

I claim:

1. A bow sling for attachment to an archery bow having a hand grip, a pair of limbs extending from the hand grip in opposite directions having ends, and a bow string extending between the ends of the limbs, comprising, in combination, an elongated strap formed of elastomeric material, said strap having a pair of integral, elongated legs extending from a first end adapted to be attached to the bow's limbs and a second end having fastening means adapted to be anchored with respect to the archer such that said strap extends over the shoulder of the archer's bow holding arm to support the bow in front of the archer, the elasticity of the strap material permitting the strap to automatically accommodate itself to a length necessary to permit the archer to raise and draw the bow to a firing position and bias the hand grip against the archer's palm.

2. A bow sling for attachment to an archery bow having a hand grip, a pair of limbs extending from the hand grip in opposite directions having ends, and a bow string extending between the ends of the limbs, comprising, in combination, an elongated strap formed of a elastomeric material having first and second ends, a pair of integral, elongated legs extending from said strap's first end, each of said legs having an outer end, first fastening means defined upon each of said leg's outer ends for fastening said legs to the bow's limbs at spaced locations on opposite sides of the hand grip, and second fastening means defined upon said strap adjacent said second end adapted to anchor said strap with respect to the archer such that said strap extends over the archer's shoulder of the bow holding arm to support the bow in front of the archer in a carrying position and the elasticity of the strap material permits the archer to grasp and raise the bow to a firing position and biases the hand grip against the archer's palm.

3. In a bow sling as in claim 2, wherein said legs are homogeneously formed of the material of said elongated strap.

4. In a bow sling as in claim 2 or 3, wherein said second fastening means comprise a loop adapted to extend around a portion of the archer's body.

5. In a bow sling as in claim 4, wherein said loop comprises a shoulder encircling loop.

6. In a bow sling as in claim 5, adjustment means defined on said second fastening means and said strap for adjusting the size of said loop.

7. In a bow sling as in claim 2, wherein said first fastening means comprise a pair of fastener portions affixed to said leg ends for holding said legs in a closed loop about the respective bow's limbs.

8. A bow sling for attachment to an archery bow having a hand grip comprising, in combination, an elongated strap of elastomeric material, said strap having first and second ends, a pair of elongated legs homogeneously extending from said first end, each of said legs having an outer end, attachment means defined upon said legs, outer ends for attaching said legs upon themselves when folding said legs back over upon themselves to form a bow limb receiving loop, and a shoulder receiving loop defined upon said strap adjacent said second end adapted to anchor said strap with respect to the archer such that said strap extends over the archer's shoulder of the bow holding arm to support the bow in front of the archer in a carrying position and the elasticity of the strap material permits the archer to grasp and raise the bow to a firing position and biases the hand grip against the archer's palm.

9. In a bow having a sling as in claim 8, said legs being homogeneously formed of the material of said strap.

10. In a bow sling as in claim 8, a plurality of spaced fasteners affixed to said strap along the length thereof, said shoulder receiving loop being formed by a second strap having a pair of ends, and a fastener affixed to each end of said second strap selectively connectable to one of said plurality of said spaced fasteners to define said shoulder receiving loop.

* * * * *